United States Patent [19]

Suzuki

[11] Patent Number: 4,628,192

[45] Date of Patent: Dec. 9, 1986

[54] CASH HANDLING MACHINE

[75] Inventor: Tadao Suzuki, Ashiya, Japan

[73] Assignee: Omron Tateisi Electronics Co., Kyoto, Japan

[21] Appl. No.: 797,944

[22] Filed: Nov. 14, 1985

[30] Foreign Application Priority Data

Nov. 19, 1984 [JP] Japan ..... 59-175971[U]

[51] Int. Cl.[4] ..... G07G 5/00

[52] U.S. Cl. ..... 235/1 R; 109/24.1; 109/66; 235/4

[58] Field of Search ..... 235/1 R, 2–6, 235/7 R, 7 A, 32, 100; 109/4, 5, 10, 24.1, 66

[56] References Cited

U.S. PATENT DOCUMENTS 1,949,283 2/1934 Murtaugh, Jr. ..... 109/24.1

4,312,277 1/1982 Grief et al. ..... 109/66 X

*Primary Examiner*—Benjamin R. Fuller

*Attorney, Agent, or Firm*—Stevens, Davis, Miller & Mosher

[57] ABSTRACT

The cash handling machine with a cash containing device housed within a safe and a receipt printer mounted on the safe comprises a cash carrying device for carrying cash from the cash containing device to an operation panel cash outlet and a receipt carrying device for carrying a printed receipt to an operation panel receipt outlet. Since the receipt carrying device is pivotally supported by the receipt printer at one end thereof and disposed obliquely between the receipt printer and the receipt outlet, it is possible to bring the receipt outlet into close proximity to the cash outlet in the operation panel even where the safe wall is sufficiently thick for crime prevention. Therefore, the user can readily take both the discharged cash and receipt simultaneously. Further, the receipt carrying device can be moved backward for easy access thereto in case of receipt jamming trouble.

3 Claims, 4 Drawing Figures

CASH HANDLING MACHINE

BACKGROUND OF THE INVENTION

The present invention relates generally to a cash handling machine, and more particularly to machines represented by automated teller machines, cash dispensers, cash exchangers, etc. installed and used in financial facilities such as banks or automatic dispensers for handling various goods.

As a matter of course, a cash handling machine is provided with a cash containing device for receiving charged cash and/or previously storing cash to be discharged. From the standpoint of crime prevention, in particular, there exist some requirements in installing the cash containing device. These requirements are a strong structure proof against actions of explosions or destructions, a sufficient weight difficulty to be carried, etc. In the case of existence of these requirements, the cash containing device is housed within a safe formed by concrete or a special alloy so as to have a great weight of one ton or more, for instance, and further fixed by anchor bolts.

On the other hand, the above-mentioned cash handling machine is provided with a receipt printer for issuing a receipt on which an amount of cash charged or discharged, date, customer ID code, and other transaction data, where necessary, are printed.

In the operation panel of the cash handling machine, there are arranged a keyboard necessary for machine operation, a cash inlet or outlet slot, a receipt outlet slot, etc. In an automatic cash dispenser for discharging cash, in particular, it is strongly required that the cash outlet and the receipt outlet are formed in closely adjacent spaced relationship to each other. This is because when there two outlets are close to each other, the user can receive the discharged cash and receipt in one hand simultaneously, and further it is possible to previously prevent the user from forgetting to take either of the cash or the receipt.

In the case where the cash containing device as described above is installed within a thick-walled safe, even if the receipt printer for issuing the receipt is disposed adjacent to the safe, it is difficult to reduce the space between the cash outlet and the receipt outlet in the operation panel from the structual standpoint because the thick wall of the safe intervenes between the cash containing device and the receipt printer. To solve the above problems, it would be possible to form the cash outlet and the receipt outlet in closely adjacent spaced relationship in the operation panel by additionally arranging a receipt carrying device for sending a receipt from the receipt printer to the receipt outlet formed in the operation panel. In this arrangement, however, it is desired to previously take proper maintainance facilitating measures against receipt carriage trouble due to receipt jamming or other causes which will occur in the receipt carrying device.

SUMMARY OF THE INVENTION

With these problems in mind, therefore, it is the primary object of the present invention to provide a cash handling machine which can satisfy the above-mentioned requirements such that even where the cash containing device is disposed within a thick-walled safe, the cash inlet or outlet and the receipt outlet can be formed in closely adjacent spaced relationship in the operation panel, and additionally a proper measure is taken against receipt carriage trouble which may occure in the receipt carrying device disposed between the receipt printer and the receipt outlet formed in the operation panel.

To achieve the above-mentioned object, the cash handling machine according to the present invention, which includes a cash containing device housed within a safe and formed with a cash container inlet or outlet, a receipt printer mounted on the safe movably backward for printing transaction data on a receipt, and an operation panel disposed in front of the safe and the receipt printer and formed with a cash inlet or outlet and a receipt outlet, is characterized in that there are disposed cash carrying means for carrying cash discharged from the cash containing device at the cash container outlet to the cash outlet formed in the operation panel or for carrying cash inserted into the cash inlet formed in the operation panel to the cash container inlet of the cash containing device, and receipt carrying means for carrying a receipt on which predetermined data are printed by the receipt printer to the reciept outlet formed in the operation panel, and in that said receipt carrying means is pivotally supported by the receipt printer at one end thereof.

In the cash handling machine according to the present invention, since cash carrying means is disposed between the cash container inlet or outlet and the operation panel cash inlet or outlet, even if the safe wall is sufficiently thick, it is possible to carry cash from cash containing device to the operation panel outlet or vice versa.

Similarly, since receipt carrying means is disposed between the receipt printer and the operation panel receipt outlet, it is possible to carry a receipt issued from the receipt printer to the operation panel receipt outlet.

Further, since the receipt carrying means is pivotally supported by the receipt printer at one end of the carrying means, it is possible to dispose the receipt carrying means obliquely at the normal setting position, thus allowing the receipt outlet to be positioned closely adjacent to the cash outlet or inlet in the operation panel.

Furthermore, since the receipt printer is movable along on the safe and the receipt carrying means is pivotable at one end thereof, it is possible to raise the obliquely disposed receipt carrying means to its horizontal position while moving it backward together with the receipt printer. Therefore, in case where receipt carriage trouble due to receipt jomming, for instance, occurs in the receipt carrying means, it is possible to readily take action against the trouble.

BRIEF DESCRIPTION OF THE DRAWINGS

Preferred embodiments of the present invention are set forth in the following description and shown in the drawings in which.

DETAILED DESCRIPTION OF THE PREFERRED EMBODIMENTS

This embodiment will be described with respect to its application to an automatic cash dispenser or a transaction performing system or machine installed in financial facilities such as banks for allowing cash to be withdrawn from user's account after confirmation that the user is qualified to perform cash transaction on the basis of an appropriate ID card or other medium.

Figure 1:
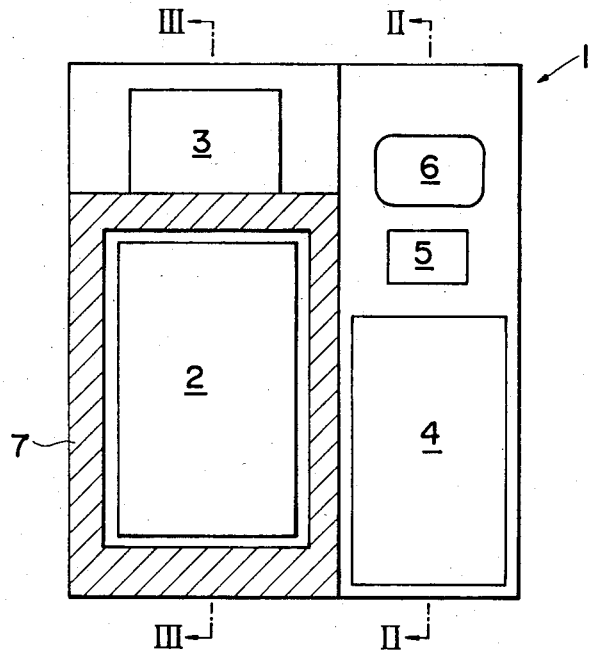
FIG. 1 is a longitudinal cross-sectional view showing a schematic exemplary arrangement of units or components constituting the cash handling machine according to the present invention.
Figure 2:
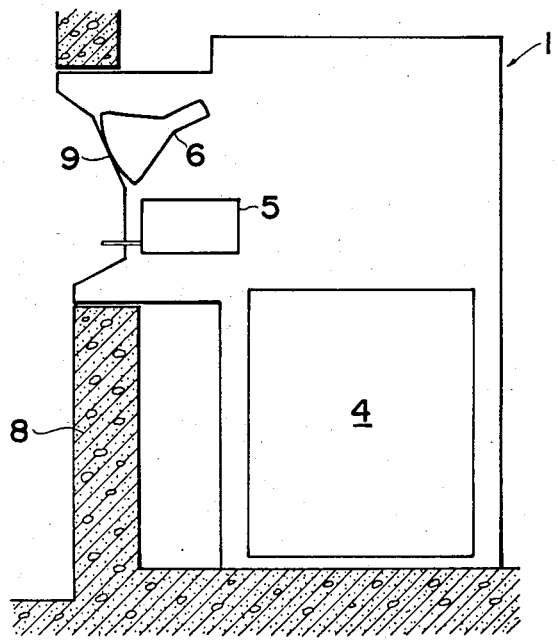
FIG. 2 is a schematic cross-sectional view taken along the line II—II shown in FIG. 1.
Figure 3:
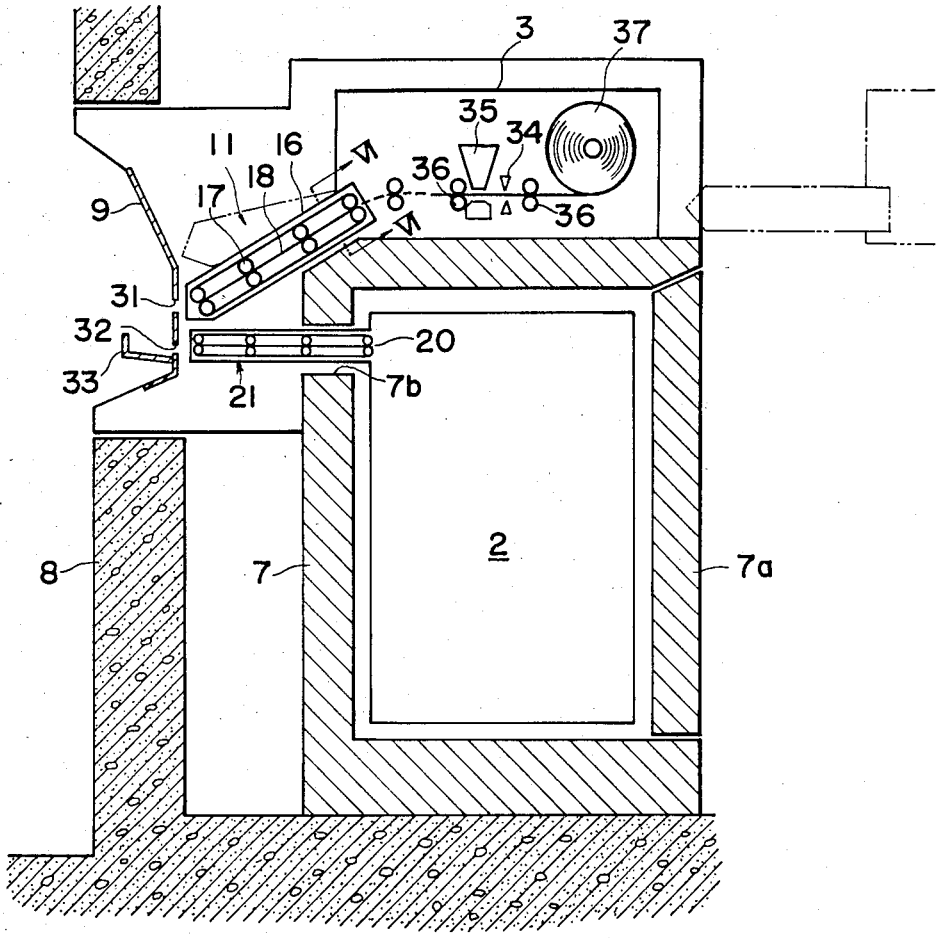
FIG. 3 is an enlarged detailed cross-sectional view taken along the line III—III shown in FIG. 1.

In FIGS. 1 to 3, the automatic cash dispenser 1 is composed of several units or components. When viewed from the front, on the left hand in FIG. 1, there are disposed a bill containing device 2, a safe 7 in which the bill containing device 2 is housed, and a receipt printer 3 mounted on the safe 7 so as to be movable backward, on the right hand, there are arranged a CRT display device 6 for instructing the user how to operate it, a card reader 5 for reading data recorded on a user card and writing on appropriate data thereon if necessary, and a controller 4 for controlling the whole operations of the cash dispenser 1 for executing the cash transaction processing.

The automatic cash dispenser 1 is installed within a wall 8 of a building. This wall 8 is formed generally thick and strong from the standpoint of crime prevention. In an opening formed in the wall 8, a panel 9 operated by the user is disposed so as to block the wall opening. This panel 9 can be opened or closed, and is locked with a key generally.

In the operation panel 9, a screen of the CRT 6 is exposed. Further, in the operation panel 9, there are formed a card inlet slot leading to the inside of the card reader 5, a receipt outlet 31, a bill outlet 32, etc. and there is disposed a keyboard for entering an amount of money to be paid, the secret number, or other transaction data. The receipt outlet 31 and the bill outlet 32 are arranged above and below in closely adjacent relationship. Below these two outlets, there is provided a receiver 33 for receiving a receipt and bills discharged through those two outlets 31 and 32.

The safe 7 is formed by concrete or a special metal, being thick in wall and heavy in weight (e.g. one ton or more) and fixed to the base or ground by use of anchor bolts. On the rear surface of the safe 7, a door *7a* is disposed so as to be opened or closed and locked or unlocked.

As is well known, within the bill containing device 2 housed within the safe 7, there are provided a plurality of bill containers for accommodating bills as classified according to the kinds of money, and a bill carrying device for letting out bills from these bill containers on the basis of the kinds of money and the number of bills both specified by the controller 4 and carrying the let-out bills to a container outlet 20. Additionally, where necessary, there are disposed a bill checker for inspecting whether the discharged bills are ones specified by the controller 4 and an escrow for temporarily collecting the let-out bills from the containers before carrying them to the container outlet 20.

The receipt printer 3 prints an amount of money to be paid, transaction date, user account number, or other transaction data on paper and issues a printed receipt. This receipt printer 3 is provided with a mechanism for holding a roll paper 37, a printing member 35 for printing the above-mentioned transaction data on the roll paper, a cutter 34 for cutting off the printed roll paper into a receipt, and a carrying device such as rollers 36 for carrying the roll paper and the cut-off receipt.

Figure 4:
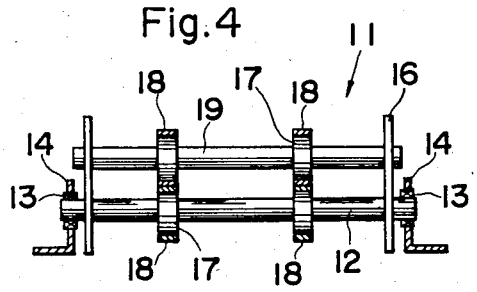
FIG. 4 is an enlarged cross-sectional view showing the receipt carrying device, taken along the line VI—VI shown in FIG. 3.

A receipt carrying device 11 is disposed in such a way as to connect the above-mentioned paper and receipt carrying assembly within the receipt printer 3 to the receipt outlet 31 formed in the operation panel 9. This receipt carrying device 11, as depicted in FIG. 4, includes a frame 16 shown on both the sides therein, a plurality of shafts 12 and 19 extending between both the side walls of the frame 16 and fixed at both the ends thereof to the frame 16, a plurality of rollers 17 rotatably fitted to these shafts 12 and 19, and two right and left pairs of upper and lower belts 18, four in total, reeved around there rollers 17, respectively. Any one of the shafts 19 is rotatably supported by the frame 16, and the corresponding rollers 17 are fixed to this shaft driven by a drive motor (not shown). With respect to the shaft 12 disposed most adjacent to the receipt printer 3, both the ends of the shaft 12 project a little as compared with other shafts and are rotatably supported through bearings 13 by two support members 14 fixed to the receipt printer 3. Therefore, the receipt carrying device 11 can oscillate with this shaft 12 as its pivotal center.

Under the normal condition where the receipt printer 3 is mounted at a predetermined position on the safe 7, as depicted by the solid lines in FIG. 3, the receipt carrying device 11 extends obliquely downward toward the operation panel 9 in such a way that the end portion of the device 11 faces the receipt outlet 31. If necessary, it is possible to rest the device 11 on the edge of the safe 7, as depicted in FIG. 3, by cutting off the upper front edge on the safe 7 obliquely. Therefore, the receipt issued from the receipt printer 3 can be sent to the receipt outlet 31 passing through the receipt carrying device 11.

At the position corresponding to the container outlet 20 of the bill containing device 2, the safe 7 is formed with a bill carrying opening *7b*. Passing through this opening *7b*, a bill carrying device 21 is disposed between the outlet 20 of the bill containing device 2 and the outlet 32 of the operation panel 9. Similarly, this bill carrying device 21 includes a frame, shafts, rollers and belts, and is driven by an appropriate driving means. Therefore, bills carried to the bill container outlet 20 within the bill containing device 2 are further sent to the bill outlet 32 of the operation panel 9 through this bill carrying device 21. Although the bill carrying device 21 is disposed horizontal in FIG. 3, it is possible to dispose this device 21 so as to extend upward toward the operation panel 9 or in other arrangements or in other directions.

The receipt printer 3 is disposed on the safe 7 being spaced upward by a thick wall away from the bill containing device 2. Therefore, there exists a great distance between the receipt outlet end of the receipt printer 3 (at the lefthand end of the receipt carrying assembly including rollers 36) and the bill outlet 20 of the bill containing device 2. However, since the arrangement is such that the above receipt outlet end is connected to the receipt outlet 31 of the operation panel 9 by the obliquely disposed receipt carrying device 11 and further the bill outlet 20 of the bill containing device 2 is connected to the bill outlet 32 of the operation panel 9 by the horizontally disposed bill carrying device 21, it is possible to bring the receipt outlet 31 into close proximity to the bill outlet 32 in the operation panel 9.

In case trouble such as receipt jamming occurs within the receipt carrying device 11, it is possible to move the receipt printer 3 backward as it is. Since the receipt carrying device 11 is pivotally attached to the receipt printer 3, as the printer 3 is shifted backward, the receipt carrying device 11 is pivoted upward horizontally as depicted by the dot-dot-dashed lines in FIG. 3, so that the carrying device 11 can be removed together with the printer 3. When the receipt carrying device 11 is sufficiently moved backward, the repair man has an easy access to the device 11 for removing a jammed receipt or for taking an appropriate action against receipt carriage trouble. After the trouble has been settled or the repair has been completed, the receipt printer 3 together with the receipt carrying device 11 is pushed toward the operation panel 9. When the printer 3 is mounted on the safe 7 at an appropriate position, the receipt carrying device 11 will automatically return to the original oblique position.

What is claimed is:

1. A cash handling machine comprising:

(a) a cash containing device housed within a safe and formed with a cash container inlet or outlet;

(b) a receipt printer mounted on the safe movably backward for printing transaction data on a receipt;

(c) an operation panel disposed in front of the safe and the receipt printer and formed with a cash inlet or outlet and a receipt outlet;

(d) cash carrying means for carrying cash discharged from the cash containing device at the cash container outlet to the cash outlet formed in the operation panel or for carrying cash charged from the cash inlet formed in the operation panel to the cash container inlet of the cash containing device; and (e) receipt carrying means for carrying a receipt on which predetermined data are printed by the receipt printer to the receipt outlet formed in the operation panel, said receipt carrying means being pivotally supported by the receipt printer at one end thereof.

2. The cash handling machine according to claim 1, wherein said receipt carrying means comprises:

(a) a frame;

(b) a plurality of shafts extending within said frame;

(c) a plurality of rollers rotatably supported by said shafts;

(d) a plurality of belts reeved around said rollers, respectively; and wherein said frame is pivotablly supported by mounting members of the receipt printer through one of said plural shafts disposed at an end of said receipt carrying means adjacent to the receipt printer.

3. The cash handling machine according to claim 1, wherein when said receipt printer is mounted on the safe at an appropriate position, said receipt carrying means extends obliquely downward toward the operation panel and a front end of said receipt carrying means faces the receipt outlet formed in the operation panel.

* * * * *